United States Patent [19]

Schalch

[11] Patent Number: 4,580,715

[45] Date of Patent: Apr. 8, 1986

[54] METHOD AND APPARATUS FOR MAKING A WATER-TIGHT RADIATOR ELEMENT

[75] Inventor: Hans Schalch, St-Blaise, Switzerland

[73] Assignee: Neotech Holding AG., Kirchberg, Switzerland

[21] Appl. No.: 557,481

[22] Filed: Dec. 2, 1983

[30] Foreign Application Priority Data

Dec. 17, 1982 [CH] Switzerland ..... 7385/82

[51] Int. Cl.[4] ..... B23K 31/06

[52] U.S. Cl. ..... 228/144; 228/60; 228/173.4; 72/48; 72/210

[58] Field of Search ..... 228/60, 144, 173.4; 72/48, 210

[56] References Cited

U.S. PATENT DOCUMENTS

| | | | |
|---|---|---|---|
| 1,173,202 | 2/1916 | McKee | 228/112 |
| 1,939,770 | 12/1933 | Enghauser | 228/60 X |
| 2,277,473 | 3/1942 | Anderson | 228/232 X |
| 3,452,424 | 7/1969 | Morris | 228/17 X |

FOREIGN PATENT DOCUMENTS

| | | | |
|---|---|---|---|
| 2475708 | 8/1981 | France . | |
| 2072316 | 9/1981 | United Kingdom . | |
| 2094966 | 9/1982 | United Kingdom . | |
| 0597461 | 3/1978 | U.S.S.R. | 72/210 |

*Primary Examiner*—Nicholas P. Godici
*Assistant Examiner*—Carmine Cuda
*Attorney, Agent, or Firm*—Christie, Parker & Hale

[57] ABSTRACT

The open ends of a flat tube are closed by rolling together the edge portions of the wide, opposing sidewalls of the tube by means of two flanging rolls successively guided over these edge portions in opposite directions. One of the flanging rolls makes a longer pass than the other. The edge portions thus rolled closed are then welded to one another in a semi- or fully-automatic TIG process. The result is a clean, symmetrically shaped radiator element.

4 Claims, 5 Drawing Figures

METHOD AND APPARATUS FOR MAKING A WATER-TIGHT RADIATOR ELEMENT

BACKGROUND OF THE INVENTION

1. Field of the Invention

This invention relates to heating appliances, especially radiators, and more particularly to a method and apparatus for making a water-tight radiator element of the type produced from a flat tube having open ends which are closed and welded.

2. Description of the Related Art

In prior art methods of making such radiator elements, the open ends of the flat tube are closed by means of sealing covers which are inserted in the respective tube ends and welded to the sidewalls of the tube. In other such elements, a filler part is inserted in the flat tube near each open end and likewise welded or soldered to the sidewalls.

A radiator having flat elements disposed parallel to one another is described in U.K. Patent Application No. 2,094,966 A. Support parts forming the closure walls of the flat elements are inserted in the open ends of the latter and welded to the sidewalls.

None of these prior art methods yields a clean and symmetrically shaped radiator element. Moreover, the welding seams must be ground smooth when a sealing cover is inserted as well as when a filler or support part is introduced into the flat tube.

French Pat. No. 2,475,708 describes a radiator having flat elements disposed parallel to one another, the ends of which are sealed by bending the edge portions of the opposing wide side surfaces of the flat tube toward the middle of the ends and then welding them to one another. Sealing is not accomplished by means of rollers, however. Here, too, the surface of the bent edge portions with the welding seam is not cleanly formed.

In another prior art radiator element of this type, the open ends of the flat tube are closed by means of rollers and a support mandrel, whereupon the closed element is welded. One drawback of this method is that because of the opening for the mandrel, the element is not completely closed and is therefore not suitable for further processing by means of pressing and welding.

SUMMARY OF THE INVENTION

It is an object of this invention to provide an improved method and apparatus whereby a water-tight radiator element having a clean and symmetrically shaped surface may be produced.

A further object of this invention is to provide such a method and apparatus whereby production costs are kept low.

To this end, in the method according to the present invention, the sealing of each end of the flat tube takes place by rolling edge portions of the wide, opposing sidewalls of the flat tube together by means of at least one flanging roll guided successively from the two sides over the edge portions toward the middle of the ends, after which the edge portions rolled closed are welded to one another in a semi- or fully-automatic tungsten inert gas process.

The flanging roll preferably makes two passes, one longer than the other, the two passes partially overlapping.

The apparatus according to the invention, for carrying out the above method, accommodates in a single unit a device for rolling the edge portions closed and a device connected thereto for welding the rolled-closed edge portions of the wide, opposing sidewalls of the flat tube.

BRIEF DESCRIPTION OF THE DRAWINGS

A preferred embodiment of the invention will now be described in detail with reference to the accompanying drawings, in which.

DETAILED DESCRIPTION OF THE PREFERRED EMBODIMENT

Figure 1:
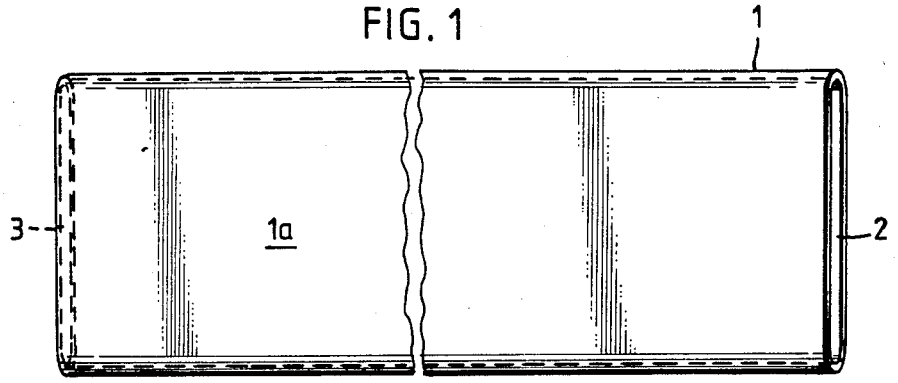
FIG. 1 is a perspective view of a top of a flat tube with open ends, used for making a radiator element.

A flat tube 1 having open ends 2, 3 as shown in FIG. 1 is used for making a water-tight radiator element. The walls of such a tube 1 are about 1.25 to 2 mm thick. Tube 1 has wide, opposing sidewalls 1*a*, 1*b* (FIG. 3) and is first cut to the desired length.

Figure 2:
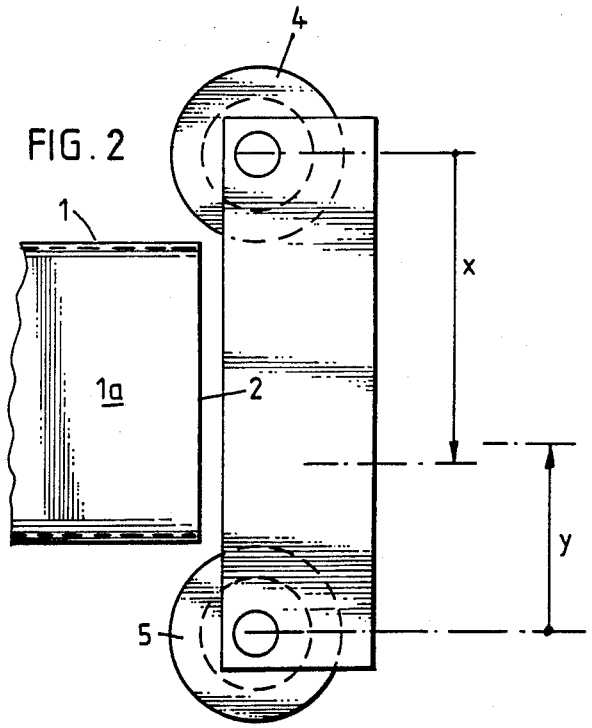
FIG. 2 is a diagrammatic top plan view of one of the open ends of the flat tube of FIG. 1 together with two flanging rolls which are guided over the edge portions of the wide, opposing sidewalls of the flat tube.
Figure 4:
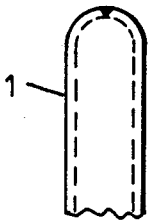
FIG. 4 is a partial side elevation of the finished radiator element.
Figure 3:
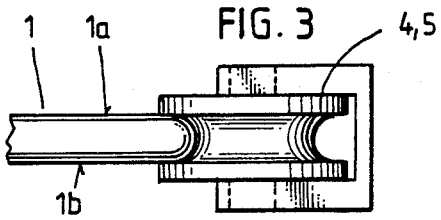
FIG. 3 is a diagrammatic side elevation of the aforementioned open tube end with edge portions rolled closed by one of the flanging rolls.

As may be seen from FIGS. 2 to 4, tube 1 is closed at its ends 2, 3 and welded. Closing of each flat-tube end 2, 3 takes place by rolling edge portions of sidewalls 1*a*, 1*b* together by means of two flanging rolls 4, 5. These rolls are successively guided in opposite directions over the edge portions of sidewalls 1*a*, 1*b*, each from one side of tube 1 toward the middle of each end 2, 3. The first flanging roll 4 travels over a longer path x when making its pass than does roll 5. In order to obtain a clean, symmetrically shaped element, tube 1 must be overlappingly deformed by rolling from both sides at ends 2, 3, i.e., the rolling distances x, y of first and second flanging rolls 4, 5 must partially overlap.

After the edge portions of sidewalls 1*a*, 1*b* have been rolled together, these closed edge portions are welded to one another in a semi-automatic or fully-automatic tungsten inert gas (TIG) process. The element closed by rolling is well suited for this pressure-welding process, both steps being carried out in the apparatus to be described below. After welding by means of the semi- or fully-automatic TIG process, there is no need for any subsequent smoothing. The finished radiator element is cleanly shaped and water-tight.

Figure 5:
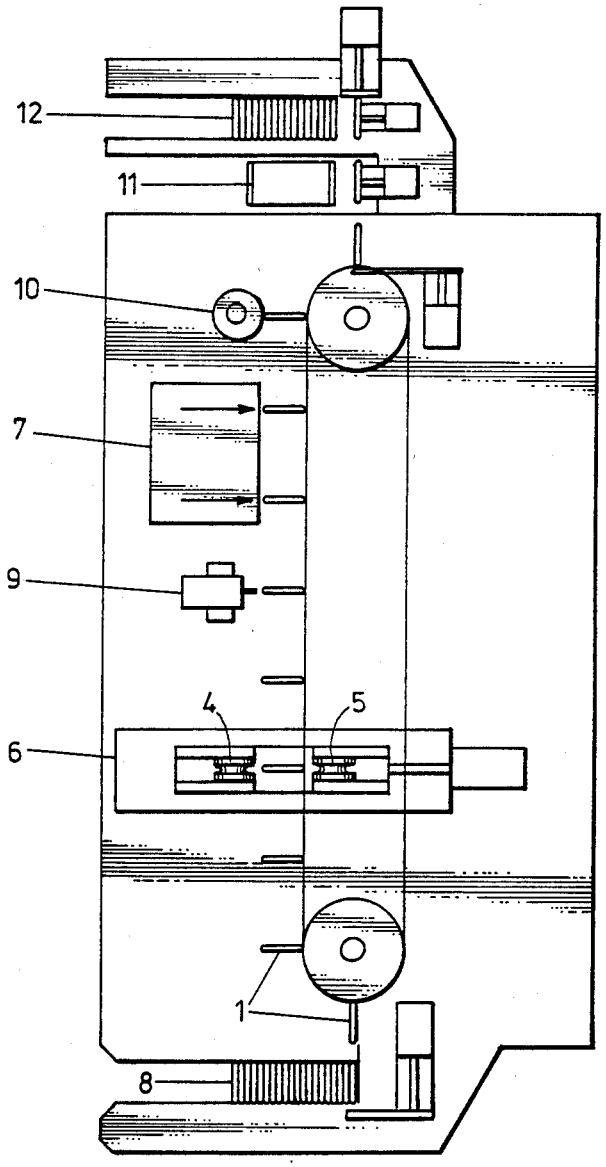
FIG. 5 is a diagrammatic top plan view of apparatus having various devices for producing the finished radiator element.

FIG. 5 illustrates apparatus in which the above-mentioned method steps are carried out in one continuous operating cycle. Accommodated in a single unit are a device 6 for rolling together the edge portions of the wide, opposing sidewalls 1*a*, 1*b* of flat tube 1 by means of two flanging rolls 4, 5, and a device 7 connected thereto for welding the roll-closed edge portions in a semi- or fully-automatic TIG process. In addition, the apparatus comprises a flat-tube magazine 8, a hole-puncher 9, brushes 10, a transverse conveyor 11, and a magazine 12 for finished radiator elements.

The finished radiator elements are then conveyed from magazine 12 to a further apparatus (not shown) where they are welded to a collecting pipe for supplying hot water and a collecting pipe for carrying off cooled water.

No additional components such as sealing covers, filler parts, or support parts are necessary for producing the radiator element. With simple means, a cleanly and symmetrically formed element is obtained, any subsequent grinding or smoothing being superfluous.

What is claimed is:

1. A method for making a water-tight radiator element from a flat tube having open ends formed by two opposing sidewalls with edge portions and by first and second longitudinal sides at opposite ends of and between the opposing sidewalls, the method comprising the steps of:

guiding at least one flanging roll simultaneously along both of the two opposing sidewalls successively in a first direction from the first longitudinal side toward a middle of the open ends and in a second direction substantially opposite the first from the second longitudinal side toward the middle to roll the edge portions together to a closed abutting position; and welding the edge portions when in the closed abutting position to one another in a semiautomatic or automatic tungsten inert gas process.

2. The method of claim 1, wherein said flanging roll makes two passes, a rolling distance of one pass being longer than that of a second other pass.

3. The method of claim 2, wherein said passes partially overlap.

4. An apparatus for making a water-tight radiator element from a flat tube having open ends formed by two opposing sidewalls with edge portions and by first and second longitudinal sides at opposite ends of and between the opposing sidewalls, the apparatus comprising:

one reciprocating roller means for rolling simultaneously along both of the at least two opposing side walls successively in a first direction from the first longitudinal side toward a middle of the open ends and in a second direction substantially opposite the first from the second longitudinal side toward the middle to roll the edge portions together to a closed abutting position; and a welder for welding the edge portions when in the closed abutting position to one another.

* * * * *